US005715554A

United States Patent [19]

Downs et al.

[11] Patent Number: 5,715,554

[45] Date of Patent: Feb. 10, 1998

[54] BICYCLE PUMP AND TIRE REPAIR APPARATUS

[75] Inventors: Robert M. Downs; Gene P. Stienecker, both of Madison; Stephen J. Baumann, Oconomowoc, all of Wis.

[73] Assignee: Trek Bicycle Corporation, Waterloo, Wis.

[21] Appl. No.: 684,266

[22] Filed: Jul. 17, 1996

[51] Int. Cl.[6] ..... B25F 1/00

[52] U.S. Cl. ..... 7/138; 7/138; 7/100; 7/164; 7/170; 152/415

[58] Field of Search ..... 7/138, 100, 164, 7/170; 152/415

[56] References Cited

U.S. PATENT DOCUMENTS

D. 343,397 1/1994 Wang ..... D15/7
4,120,614 10/1978 Bouder ..... 417/63
5,020,706 6/1991 Birch ..... 224/39
5,513,508 5/1996 Saunders et al. ..... 152/415

*Primary Examiner*—James G. Smith
*Assistant Examiner*—Lee Wilson
*Attorney, Agent, or Firm*—Nilles & Nilles, S.C.

[57] ABSTRACT

A bicycle pump and tire repair apparatus incorporating into a single unit an air pump for inflating a bicycle tire, a tire lever for removing a tire from a bicycle rim, a spoke wrench for repairing and adjusting the spokes of a rim, and a compartment for storing a patch for repairing a punctured bicycle tire is disclosed. The air pump is compactly designed for carrying on a bicycle. A thumblock on the head of the pump performs a dual function of locking the nozzle of the pump onto the valve of a tire being inflated, and it functions as a tire removal lever. A cap on the head of the pump has a knurled surface for abrading an inner tube to prepare it for application of a patch. A slot in the pump handle holds a second tire lever, and a compartment in the end cap of the handle stores a self-adhesive patch for repairing a punctured tire.

9 Claims, 5 Drawing Sheets

BICYCLE PUMP AND TIRE REPAIR APPARATUS

BACKGROUND OF THE INVENTION

1. Field of the Invention

The present invention relates to a bicycle pump and tire repair apparatus. In particular, the invention relates to an air pump for inflating bicycle tires, wherein the air pump includes a tire lever, spoke wrench, storage compartment for storing a tire patch, and additional features used for repairing a bicycle tire.

2. Description of Related Art

A pneumatic bicycle tire typically comprises a metal wheel rim, a rubber tire, and a rubber inner tube for inflating the tire. Since the time that pneumatic tires have been used on bicycles, such tires have been subject to puncture resulting in what is commonly known as a "flat tire." In order to repair a flat tire, one must remove the rubber tire from the wheel rim, patch the punctured inner tube, replace both the inner tube and tire onto the wheel rim, and re-inflate the tire. Occasionally the spokes must also be fixed or adjusted. A number of separate tools for repairing a flat tire and an air pump for re-inflating it are ordinarily required to complete the job.

Persons going on a long bicycle trip occasionally encounter a flat tire while they are far from a place which might assist in repairing the tire. Flat tires and damage to wheel rims are also commonly encountered in a particularly rugged version of off-road bicycling which has become known as "mountain biking." Also, a bicycle racer must carry the tools and materials necessary for quickly repairing a tire, otherwise he or she risks dropping out of the race in the event of a flat tire. In all such circumstances it is cumbersome to carry all of the things needed to repair a flat tire. Consequently, there is a need for an apparatus which includes all of the tools and materials necessary to repair a flat tire or damaged wheel rim, and which can be carried conveniently and compactly on a bicycle.

SUMMARY OF THE INVENTION

A bicycle air pump incorporating a tire lever, a spoke wrench, a tire patch compartment and additional components necessary for repairing a bicycle tire is disclosed. The invention comprises a compact air pump which includes a pump head cap that has a spoke wrench fitting for emergency spoke adjustment. A thumblock lever on the head of the pump is designed to be functional as a tire lever for removing the rubber tire from the metal wheel rim. The handle of the pump holds a second tire lever which slides into a slot in the handle. An end cap on the handle also includes a compartment for holding a patch for repairing a puncture on the inner tube of the tire.

The principle objects of the invention are therefore to provide in a single compact unit an air pump for inflating a bicycle tire, tools for removing and replacing a rubber tire onto the metal wheel rim, materials for patching a punctured inner tube, and a tool for repairing or adjusting the spokes of a bicycle wheel. Other objects and advantages of the invention will become apparent from the following description which, taken in conjunction with the accompanying drawings, sets forth by way of illustration and example certain embodiments of this invention.

BRIEF DESCRIPTION OF THE DRAWINGS

The drawings, which constitute part of this specification and include exemplary embodiments of the present invention, include the following.

DETAILED DESCRIPTION OF THE INVENTION

Figure 1:
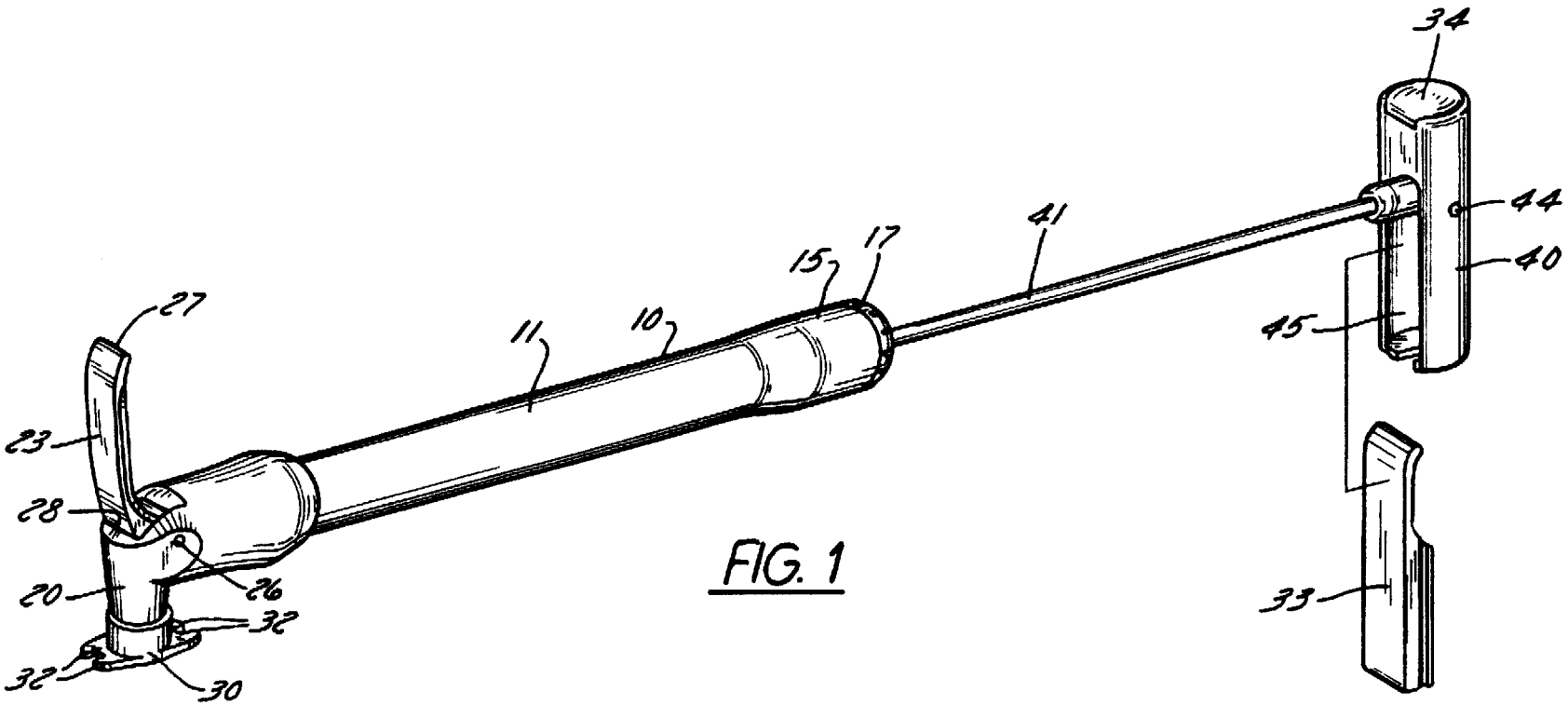
FIG. 1 is a perspective view of the bicycle pump and tire repair apparatus of the present invention.
Figure 2:
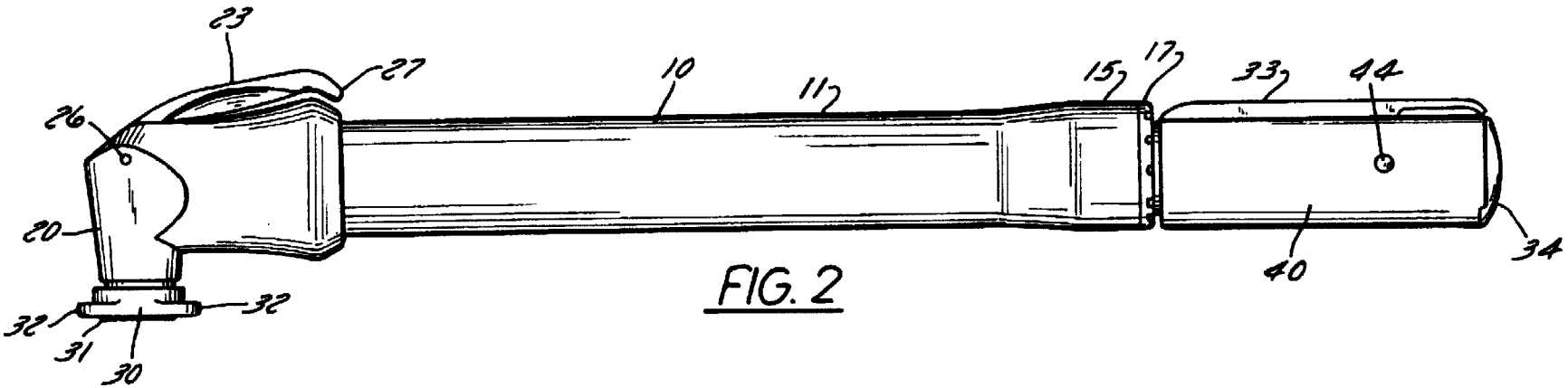
FIG. 2 is a side view of the bicycle pump.
Figure 4:
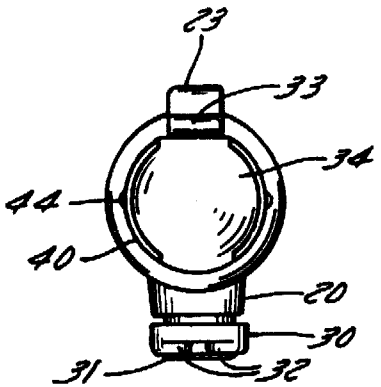
FIG. 4 is a rear view of the head of the pump handle.
Figure 3:
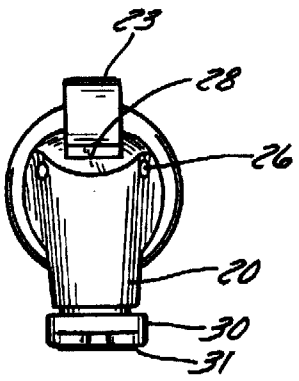
FIG. 3 is a front view of the head of the bicycle pump.
Figure 5:
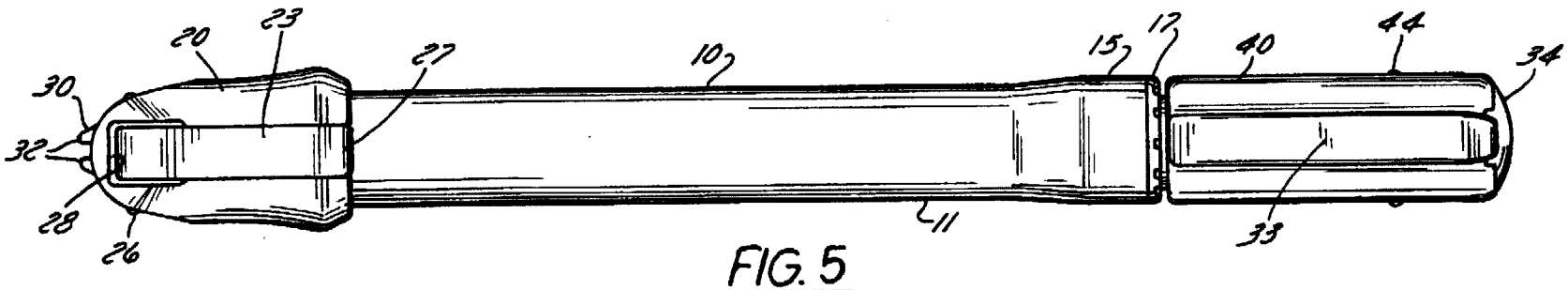
FIG. 5 is a top view of the bicycle pump.
Figure 6:
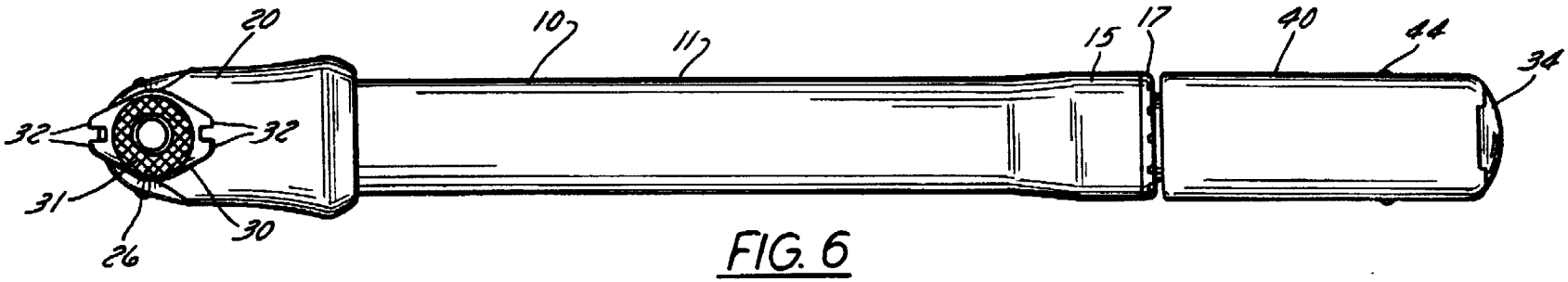
FIG. 6 is a bottom view of the bicycle pump.

Referring to the drawings, the main components of the bicycle pump and tire repair apparatus of the present invention comprise a barrel 10, a head 20, and a handle 40 connected to a plunger.

Figure 7:
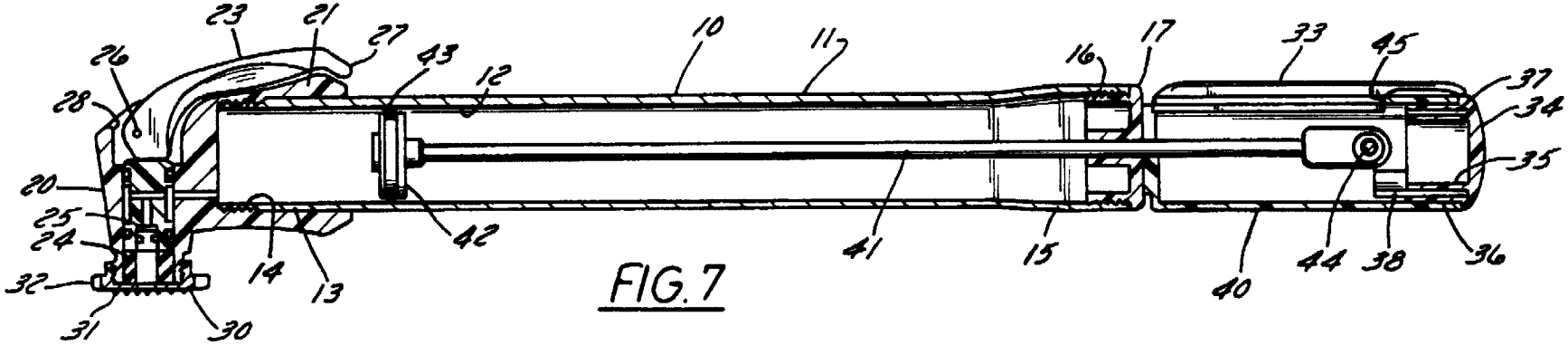
FIG. 7 is a cross section view of the bicycle pump.
Figure 10:
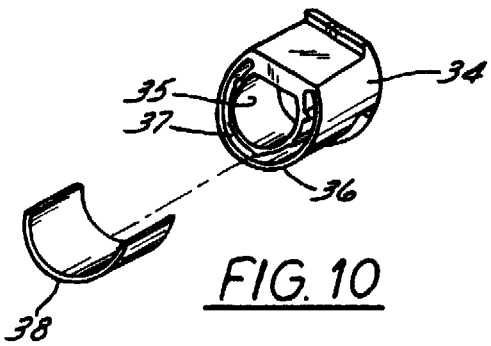
FIG. 10 is a perspective view of the end cap of the pump handle and a patch which may be inserted into a slotted compartment in the end cap.
Figure 9:
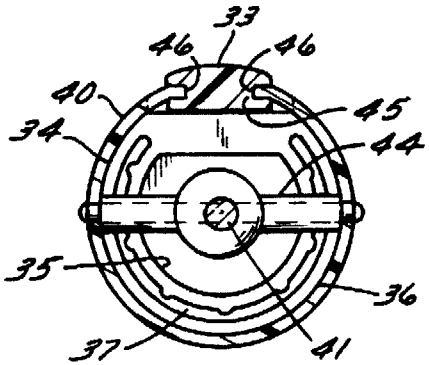
FIG. 9 is a cross section view of the handle of the pump.
Figure 8:
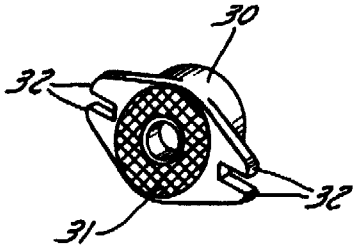
FIG. 8 is a perspective view of the pump head cap.
Figure 11:
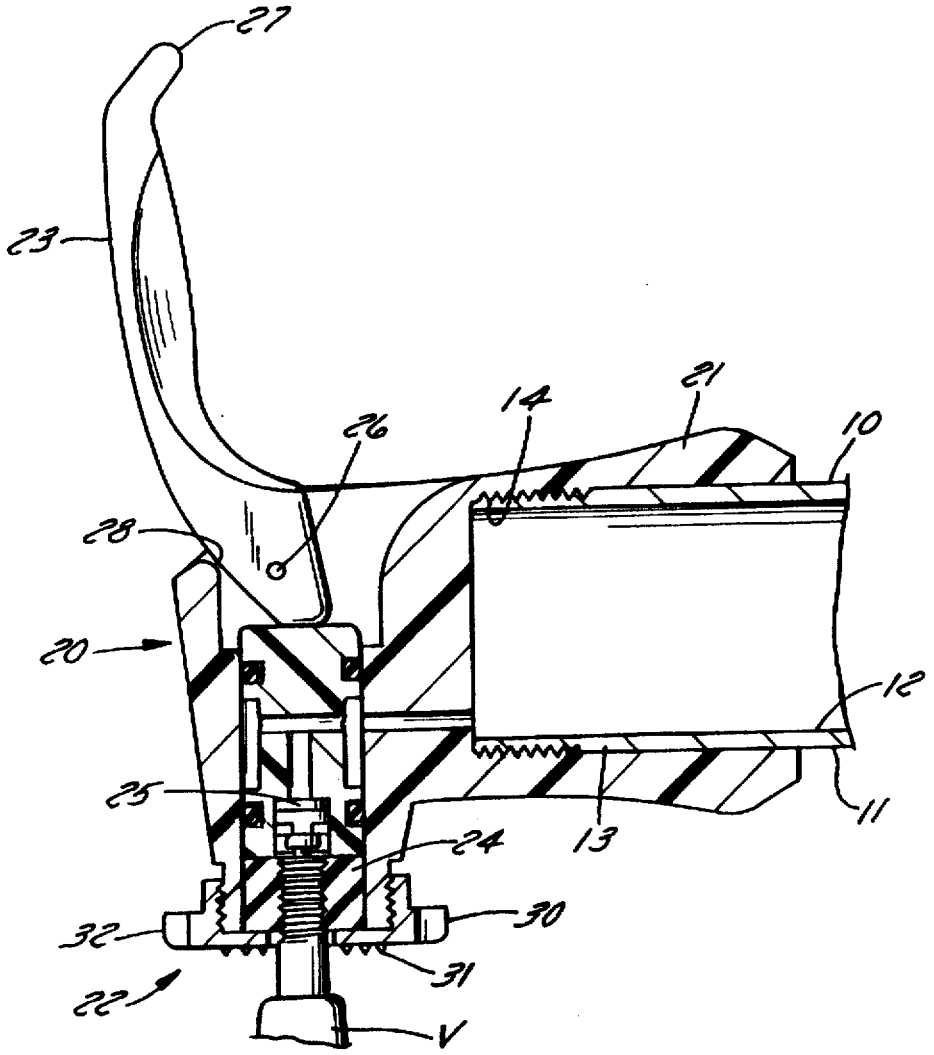
FIG. 11 is a cross section view of the pump head.

The barrel 10 essentially comprises an elongated, cylindrical metal tube 11 having a relatively thin wall 12 and hollow center. The head 20 of the pump is connected to one end 13 of the barrel 10. Referring to FIGS. 7 and 11, the first end 13 of the barrel has a threaded portion 14 for fastening the head 20 of the pump thereto, although other means for fastening the head of the pump to the barrel may be employed. At the opposite end, i.e., the second end 15, the diameter of the barrel 10 is slightly expanded in comparison to the diameter of the remainder of the barrel 10. An end cap 17 covers the expanded second end 15 of the tube. Again, FIGS. 7 and 11 show a second threaded portion 16 for attaching the end cap 17 into the second end 15 of the barrel 10, although other means may be employed for attaching the end cap 17 to the barrel 10.

A plunger which moves back and forth within the barrel is used to operate the air pump. The plunger comprises a plastic disk 42 which has a diameter which is slightly smaller than the diameter of the hollow center of the barrel 10. A rubber O-ring 43 seals the small space between the plastic disk 42 and the interior wall 12 of the barrel 10. A metal rod 41 connected to the disk 42 extends through the center of the barrel 10, through a central opening in the end cap 17, and outward therefrom where it is connected by a pivot pin 44 to the handle 40. The air pump is operated by moving the handle 40 back and forth, which in turn moves the plunger back and forth within the barrel 10 in order to force air out of the head 20 and into the bicycle tire being inflated.

Referring again to FIGS. 7 and 11, the head 40 of the pump comprises an air inlet 21 connected to the first end 13 of the barrel 10, a nozzle 22, and a thumblock lever 23 for locking the nozzle 22 onto a valve V of an inner tube being inflated. The air inlet 21 comprises a tubular section having a diameter corresponding to the diameter of the barrel 10 and a threaded portion for fastening the head 20 to the barrel 10. The nozzle 22 includes a rubber gasket 24 which, in a non-compressed state, fits over the valve V of the inner tube. A head cap 30 fastened to the end of the nozzle 22 holds the gasket 24 in the nozzle 22. In order to lock the nozzle 22 of the pump onto the valve V of the inner tube, the thumblock lever 23 is rotated upward (as shown in FIG. 11), which causes the rubber gasket 24 to become compressed against the head cap 30, thereby narrowing the central opening of the gasket 24 and sealing it around the end of the valve V of the inner tube. A check valve 25 is also incorporated into the head 20 of the tube.

The head cap 30 is threaded onto the end of the nozzle 22 of the head 20. An exterior flat portion of the head cap has a knurled surface 31 that can be used to abrade an inner tube to prepare the surface of the tube for application of a patch 38 in order to repair a puncture in the tube. The head cap 30 is also provided with a pair of projecting nubs 32 which function as spoke wrench fittings for adjusting the spokes of a bicycle tire. The spoke wrench fittings 32, which project outwardly from the knurled surface 31, may be used either while the head cap 30 is attached to the head 20 of the pump, or the head cap 30 may be quickly removed and used as a separate tool.

The thumblock lever 23 on the head of the pump is also specially designed to function as a tire lever for removing the tire from the wheel rim. The thumblock lever 23 essentially comprises a rigid, elongated lever in which one end of the lever is pivotally connected by a pivot pin 26 in a space within the head 20 of the pump. The opposite end of the lever has a relatively thin angled end portion 27 which can be inserted between a tire and rim in order to facilitate removal of the tire. The thumblock lever 23 is normally stored in the unlocked position by placing the thumblock lever 23 downward (as shown in FIG. 7) in a position substantially parallel to the length of the barrel 10 of the pump. Rotating the thumblock 23 upward to the locked position which is substantially perpendicular to the barrel 10 (as shown in FIG. 11) exposes the thumblock lever 23 at the proper position for use as a tire removal lever. The head 20 of the pump is reinforced with a support surface 28 for holding the thumblock lever 23 at the proper position for use as a tire lever and for supporting the lever 23 against the additional force encountered when removing a tire from the rim.

The handle 40 of the pump, which is essentially an elongated cylindrical plastic piece, is pivotally attached by a second pivot pin 44 on the end of the rod 41 of the plunger. A slot 45 in the side of the handle 40 enables the handle 40 to be stored in a position which is parallel to the barrel 10 of the pump, and, when the pump is in use, rotated approximately 90° so that it is easier to grip by the user when inflating a tire.

The handle 40 of the pump also holds a second tire lever 33 which can be used in conjunction with the thumblock tire lever 23. The second tire lever 33 slides into a pair of slides 46 in the slot 45 in the side of the handle 40 and is secured in place when the handle 40 is in the stored position. Additionally, the second tire lever 33 covers the slot 45 in the handle 40 to protect against dirt and mud from entering the internal area of the pump.

The handle 40 also includes an end cap 34 which may be removed from the handle 40. The end cap 34 has two partially cylindrical walls—an inner wall 35 and an outer wall 36. A space 37 between the inner wall 35 and outer wall 36 of the end cap 34 forms a compartment for storing a self-adhesive patch 38 for repairing a punctured bicycle tire.

It is to be understood that the embodiment disclosed above is merely exemplary of the invention, which may be embodied in various forms. Therefore, specific structural and functional details disclosed above are not to be interpreted as limiting, but merely as a basis for the claims and as a representative basis for teaching one skilled in the art to variously employ the present invention in any appropriately detailed structure. Changes may be made in the details of construction, arrangement and operation of the invention without departing from the spirit of the invention, especially as defined in the following claims.

We claim:

1. A bicycle pump and tire repair apparatus comprising:

a barrel having a first end and a second end;

a head on the first end of the barrel, said head having a nozzle, a head cap on the end of the nozzle, and a thumblock lever for locking the nozzle onto the valve of a bicycle tire;

on the second end of the barrel, a handle connected to a plunger for operating said pump; and, said head cap further comprises a spoke wrench comprising a pair of projecting nubs for adjusting the spokes of a bicycle wheel.

2. The bicycle pump and tire repair apparatus of claim 1, wherein the head cap is removably threaded onto the end of the nozzle.

3. The bicycle pump and tire repair apparatus of claim 1, wherein the head cap further comprises an exterior flat portion having a knurled surface.

4. The bicycle pump and tire repair apparatus of claim 1, wherein the thumblock lever further comprises:

a first end pivotally connected to the head of the pump;

a second end having a relatively thin, angled end portion; and the head further comprises a support surface for supporting the thumblock lever at a position substantially perpendicular to the barrel of the pump for use as a tire removal lever.

5. The bicycle pump and tire repair apparatus of claim 1, wherein the handle further comprises:

a cylindrical section having a slot therein;

the handle is pivotally connected to the plunger such that the handle may be rotated to a storage position in which the cylindrical section is substantially parallel to the barrel of the pump, and rotated to an operating position in which the cylindrical handle is substantially perpendicular to the barrel of the pump; and, a tire lever is attached over the slot of the handle.

6. The bicycle pump and tire repair apparatus of claim 5, wherein the tire lever is slidably attached into slides in the slot of the handle.

7. The bicycle pump and tire repair apparatus of claim 1, wherein the handle further comprises a compartment for storing a bicycle tire patch.

8. The bicycle pump and tire repair apparatus of claim 7, wherein the compartment comprises an end cap removably attached to the handle of the pump, and the end cap comprises an inner wall and outer wall, with a space between the inner and outer walls.

9. A bicycle pump and tire repair apparatus comprising:

a barrel, a head, and a handle connected to a plunger for operating said pump;

the head further comprising (i) a removable head cap, said head cap having a knurled surface and a said projecting nubs which function as a spoke wrench, and (ii) a thumblock lever, and (iii) a support surface for supporting the thumblock lever in a position that is substantially perpendicular to the barrel for using said thumblock lever as a tire removal lever; and, the handle comprises a substantially cylindrical section that is pivotably attached to the plunger, and further comprises (i) a second tire lever slidably attached in a slot in the handle, and (ii) an end cap having a compartment for storing a bicycle tire patch.

* * * * *